US005131612A

United States Patent [19]

Skantar

[11] Patent Number: 5,131,612

[45] Date of Patent: Jul. 21, 1992

[54] ARRANGEMENT FOR POSITIVELY DETERMINING THE ACTUAL SOUNDING OF A WARNING HORN ON A RAILWAY VEHICLE

[75] Inventor: Elmer T. Skantar, East Pittsburgh, Pa.

[73] Assignee: Westinghouse Air Brake Company, Wilmerding, Pa.

[21] Appl. No.: 624,425

[22] Filed: Dec. 7, 1990

[51] Int. Cl.[5] ..... B61L 15/00; B61L 25/00

[52] U.S. Cl. ..... 246/107; 246/185

[58] Field of Search ..... 246/1 C, 107, 167 R, 246/185, 217; 346/33 TP, 36

[56] References Cited

U.S. PATENT DOCUMENTS

| | | | |
|---|---|---|---|
| 404,032 | 5/1889 | Currier | 246/107 X |
| 482,393 | 9/1892 | Stockford | 246/185 X |
| 1,041,393 | 10/1912 | Williams et al. | 246/217 X |
| 1,190,173 | 7/1916 | Hudson | 246/185 |
| 1,304,727 | 5/1919 | Baldwin | 246/107 |
| 2,325,451 | 7/1943 | Wait | 246/185 |
| 4,052,892 | 10/1977 | Browne | 346/33 TP X |
| 4,285,483 | 8/1981 | Cipollone | 246/107 |
| 4,361,825 | 11/1982 | Shockley | 246/185 X |
| 4,720,807 | 1/1988 | Ferran et al. | 346/33 TP X |

FOREIGN PATENT DOCUMENTS

| | | | |
|---|---|---|---|
| 191855 | 7/1967 | U.S.S.R. | 346/33 TP |

*Primary Examiner*—Robert J. Spar
*Assistant Examiner*—Scott L. Lowe
*Attorney, Agent, or Firm*—J. B. Sotak

[57] ABSTRACT

A system for positively determining that an engineman has actually activated a manual whistle valve to sound a pneumatic warning horn on a railway vehicle having a low pressure and high pressure sensing apparatus for conveying signals to an event recorder for monitoring and recording the pressure of an air supply source and the sounding of the pneumatic warning device.

15 Claims, 2 Drawing Sheets

ARRANGEMENT FOR POSITIVELY DETERMINING THE ACTUAL SOUNDING OF A WARNING HORN ON A RAILWAY VEHICLE

FIELD OF THE INVENTION

This invention relates to a monitoring and recording system for positively determining the actual sounding of a warning device on a vehicle, and more particularly to an event recorder arrangement for ascertaining that a trainman has manually operated a whistle valve for causing an audible pneuphonic horn to emit a loud sound for warning and indicating that a train or transit vehicle is approaching a highway crossing or the like.

BACKGROUND OF THE INVENTION

In railroad and/or mass and rapid transit operations, it is common practice to employ an event monitoring and recording system for providing at any particular time an authentic and actual record of a given number of different occurrences that take place over an extended period of time during the course of travel of the train. In many cases, it is advantageous to provide a tangible and accurate record of each event as well as the time, day and location at which the particular individual event occurs. That is, there is a need and demand to monitor a large number of parameters or operating conditions, such as, pneumatic brake application and release, dynamic brakes, throttle setting, speed, distance traveled, time, brake pipe pressure reduction, fuel consumption, sanding, as well as warning horn actuation for immediate and subsequent evaluation. In particular, when used on a locomotive and transit car, it is immensely valuable to monitor and record the given speed and the actual sounding of the warning horn at a certain track location, such as a highway-railroad crossing, at a common grade, for subsequent review and use in case of an accident. In the past, it was the word of the engineer against that of the victim as to whether the warning device was actuated and actually sounded prior to the time of the accident. However, it is well known that air horns have a threshold level of operating pressure below which the emitted sound drops off rapidly or ceases entirely. In normal operation, the air horn has a sound level of 106 to 112 decibels (DB) at pressures of 70 to 140 psi, and has an audible range of between 5 to 5.5 miles. However, in the past there was no positive way of determining whether the operator of the train had actually operated the air horn valve and whether the air pressure of the main reservoir was above the threshold level at the time the air horn valve was actuated. It would be highly advantageous and very helpful in liability lawsuits to unequivocally provide absolute and irrefutable proof that the warning horn or bell was in fact sounded as the train approached the highway grade crossing before the occurrence of the accident. In addition, the actuation of the whistle valve and sounding of the horn could be very useful in determining and checking the alertness of the locomotive engineer or trainman which requires him to establish his vigilance and awareness as the train moves along its route of travel. For example, the operation of the air horn could be used as a signal for signifying the alertness of the operator as well as being recorded in an event recording apparatus.

OBJECTS AND SUMMARY OF THE INVENTION

Accordingly, it is an object of this invention to provide a unique monitoring and recording system for determining the actual sounding of a warning device on a vehicle.

Another object of this invention is to provide a novel event recorder for confirming and registering the operation of the air horn on a railway vehicle.

A further object of this invention is to provide a new event monitor for recording the time, date and location of the actuation of an air pressure operated warning device on a locomotive.

Yet another object of this invention is to provide a new and improved detecting system for ascertaining the operation of an air horn by sensing the level of air pressure and/or flow rate of air.

Yet a further object of this invention is to provide a new and unique detecting system for ascertaining and confirming the operation of an air horn by sensing whether the air pressure is above or below a threshold level.

Still a further object of this invention is to provide a unique arrangement for monitoring and recording the actuation of an air horn warning device.

Still another object of this invention is to provide a new air horn monitor and recorder which is simple in design, economical in cost, durable in use, efficient in service, and reliable in operation.

An additional object of this invention is to provide a system for determining the operation of a pressure-operated warning device comprising, a source of air pressure, an actuating valve for directing the flow of air under pressure to a sound warning device, means for sensing the flow of air under pressure, and means for recording the operation of the actuating valve and/or the sounding of the warning device.

Yet an additional object of this invention is to provide a warning alarm arrangement for ascertaining that an operator of a railway locomotive has taken positive action to sound an air horn, comprising a compressed air supply, a manual operating valve pneumatically connected to the compressed air supply, an air flow adapter pneumatically connected to the manual operating valve, the air horn pneumatically connected to the air flow adapter, an air flow indicator pneumatically connected to the air flow adapter, and an event recorder electrically connected to the air flow indicator for recording the actuation of the manual operating valve and the sounding of the air horn.

Still an additional object of this invention is to provide a warning alarm arrangement for determining that an operator of a railway vehicle has taken action to sound an air horn, comprising, a compressed air supply, a manual operating valve pneumatically connected to the compressed air supply, a pair of tee members pneumatically connected to the manual operating valve, the air horn pneumatically connected to the pair of tee members, a pair of pressure switches pneumatically connected to the pair of tee members, and an event recorder electrically connected to the pair of pressure switches for recording the actuation of the manual operating valve and the sounding of the air horn.

In addition, it is an object of this invention to provide a warning alarm arrangement for ascertaining that an operator of a vehicle has taken action to sound an air horn comprising, a compressed air supply, a manual operating valve pneumatically connected to the compressed air supply, a manifold pneumatically connected to the manual operating valve, the air horn is pneumatically connected to the manifold, a pair of pressure switches pneumatically connected to the manifold, and an event recorder electrically connected to the pair of pressure switches for recording the actuation of the manual operating switch and the sounding of the air horn.

DESCRIPTION OF THE DRAWINGS

The above objects and other attendant features and advantages will be more readily appreciated as the present invention becomes better understood by reference to the following detailed description when considered in conjunction with the accompanying drawings, wherein.

DETAILED DESCRIPTION OF THE INVENTION

Figure 1:
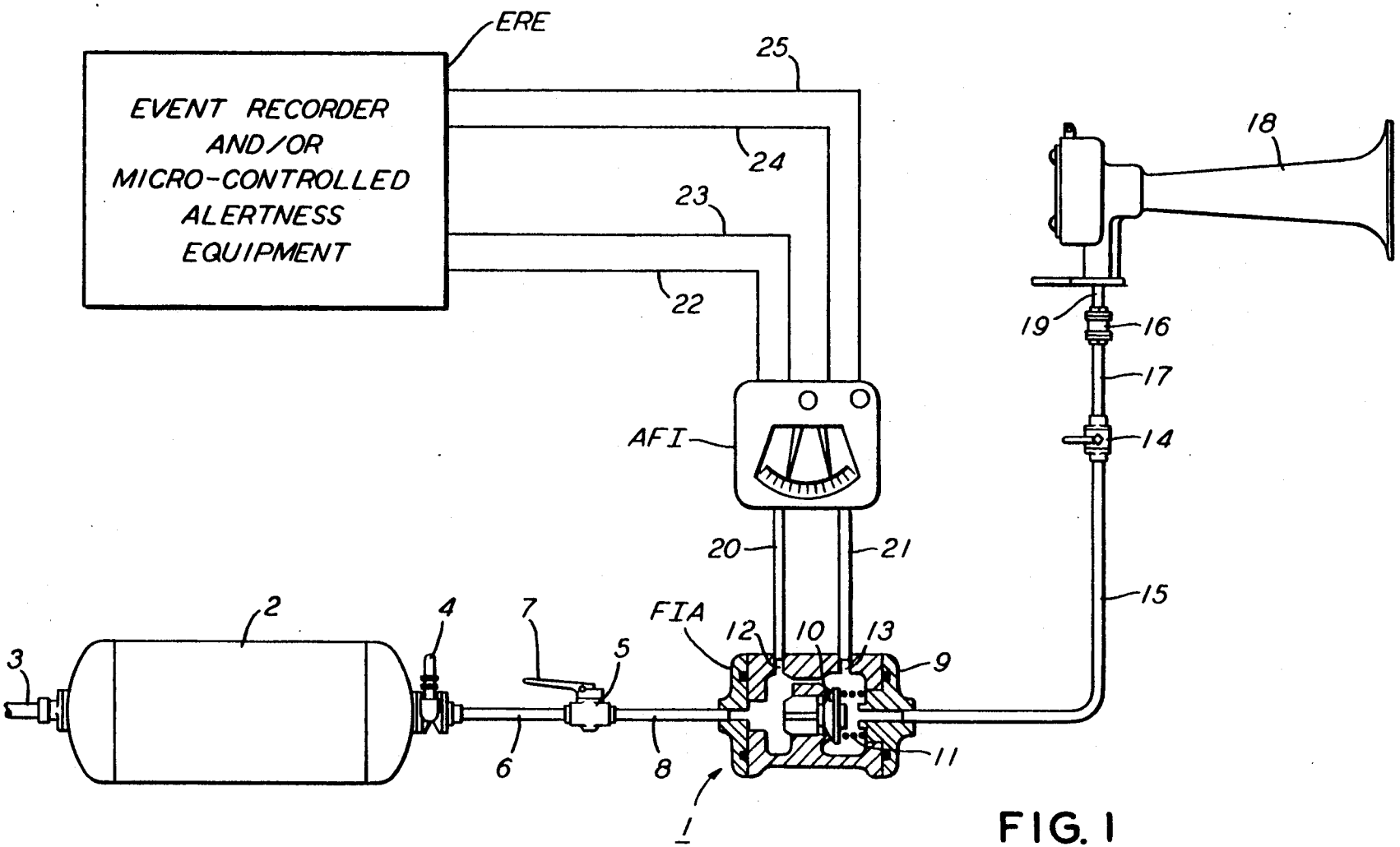
FIG. 1 is a schematic diagram of one form of a recording and monitoring system for ascertaining the sounding of an air horn on a railway vehicle in accordance with the present invention.

Referring now to the drawings, and in particular to FIG. 1, there is shown a diagrammatic view of a recording and monitoring system for determining if the operator of a railway vehicle has taken positive action to sound the pneuphonic horn by operating the whistle valve to forewarn workmen of track gangs and motorists and pedestrians at a highway-railroad grade crossing of an approaching train. As shown, the system, generally characterized by numeral 1, includes a main reservoir 2 which is supplied via pipe or conduit 3 with fluid under pressure from a source of air pressure, such as a suitable air compressor (not shown). The pressure at the outlet of reservoir 2 is regulated by a safety valve or regulator 4 which is normally set between one hundred twenty-five and one hundred forty-five pounds per square inch (125–145 psi). The outlet of the pressure regulator 4 is connected to the inlet of a whistle or horn valve 5 via pipe or conduit 6. The whistle valve 2 may be a conventional air flow control device such as an A-2 whistle valve which is made and sold by Westinghouse Air Brake Company. The valve 5 includes an internally housed plunger, valve, and valve spring, as well as an external actuating handle 7 which is manually pulled by a cord or other means by the locomotive engineer or transit operator.

It will be seen that the outlet of the whistle valve 5 is connected by conduit or pipe 8 to the inlet of a flow indicator adapter FIA which is a type of spring loaded check valve. That is, the adapter FIA includes a body 9 which houses a valve 10 and a biasing spring 11 which normally urges the valve to its closed position. A specifically sized orifice is drilled in the adapter 8 to cause a differential pressure between ports 12 and 13. As shown, the outlet of the flow indicator adapter 8 is connected to the inlet of a normally opened cutout cock 14 via pipe or conduit 15. The outlet of the cutout cock 14 is connected to the inlet of a strainer 16 via pipe or conduit 17. The strainer 16 removes any dirt and other foreign matter from entering a warning device 18 via pipe or conduit 19. In practice, the warning device which normally is pneuphonic or air horn which is sounded by the engineer or trainman as the train approaches a highway-railroad grade crossing or enters a track work area for warning motorists and pedestrians as well as the workman of a track gang of the ensuing potential danger. Usually, it is a general rule of each particular railroad that a train operator must sound the warning device, such as the air horn or whistle, as the train approaches a highway-railroad grade crossing to forewarn the traveling public of the oncoming train. In most cases, the warning consists of two long bursts followed by two short bursts of the air horn or whistle as the approaching train enters the highway crossing zone. Traditionally, the sounding of the warning device by the engineer at highway-railroad grade crossings is repeatedly raised in lawsuits after a train and motor vehicle accident. It would be highly advantageous to the railroad owners or operators to have proof positive that the trainman did, in fact, actuate the whistle valve 5 which resulted in the audible sounding of the pneuphonic horn 18 on the lead vehicle of the train. This is accomplished by sensing the level of the air pressure or the flow rate when an operator opens the whistle valve 5. As shown, a flow pipe or conduit 20 is connected from port 12 to one or a first inlet of an air flow sensing indicator AFI while a pipe or conduit 21 is connected from port 13 to another or second inlet of the air flow indicator AFI. The air flow indicator AFI may be somewhat analogous to that shown and described in U.S. Pat. No. 3,304,420. However, the present indicator includes a movable lever arm which opens and closes two pairs of electrical contacts in accordance with two different flow rates. That is, a first pair of electrical contacts is closed at a relatively low rate of flow of fluid when the differential pressure across pipe 8 and pipe 15 is not very great while a second pair of electrical contacts is closed at a relatively high rate of flow, such as, forty cubic feet per minute (40 cfm) or greater. when the fluid pressure in the inlet pipe 8 is much greater than the fluid pressure in outlet pipe 15. It will be understood that one of the first pair of electrical contacts is connected to lead 22 while the other of the first pair of electrical contacts is connected to lead 23. Similarly, one of the second pair of electrical contacts is connected to lead 24 while the other of the second pair of electrical contacts is connected to lead 25. As shown, the leads 22, 23, 24, and 25 are connected to an event recorder and/or alertness equipment ERE or a suitable microprocessor based locomotive brake system having an integrated engineman alertness feature. It will be appreciated that the microprocessor may be programmed to calculate the flow rate and to determine the low and high limits received from two transducers or from a single differential transducer. Further, the majority of recorders now in use have the capacity to record a number of events over a period of time, such as, 48 hours. As previously noted, event recorders have long been useful to FRA investigators in determining accident causation and the recording of sounding of the warning horn would be invaluable as evidence during court proceedings. Thus, a signal on leads 22 and 23 may signify a low flow rate which would indicate the engineer did indeed operate the whistle valve 5 while a signal on leads 24 and 25 may signify a high flow rate which would be positively interpreted that the air horn 15 did in fact emit an actual audible sound. It will be appreciated that air horns have a threshold level of supply pressure below which the amplitude of the emitted sound falls off rapidly or even ceases entirely. For example, a type E-2-B pneuphonic horn, made and sold by Westinghouse Air Brake Company, has a threshold pressure level of approximately forty pounds per square inch (40 psi) at the whistle valve outlet or discharge conduit 8. Thus, not only the trainman's action in operating the horn valve 5 to blow the horn 18, but also the resultant development of sufficient air to sound the horn is monitored and recorded for possible subsequent review by interested individuals and other inquisitive parties.

Figures 2, 3:
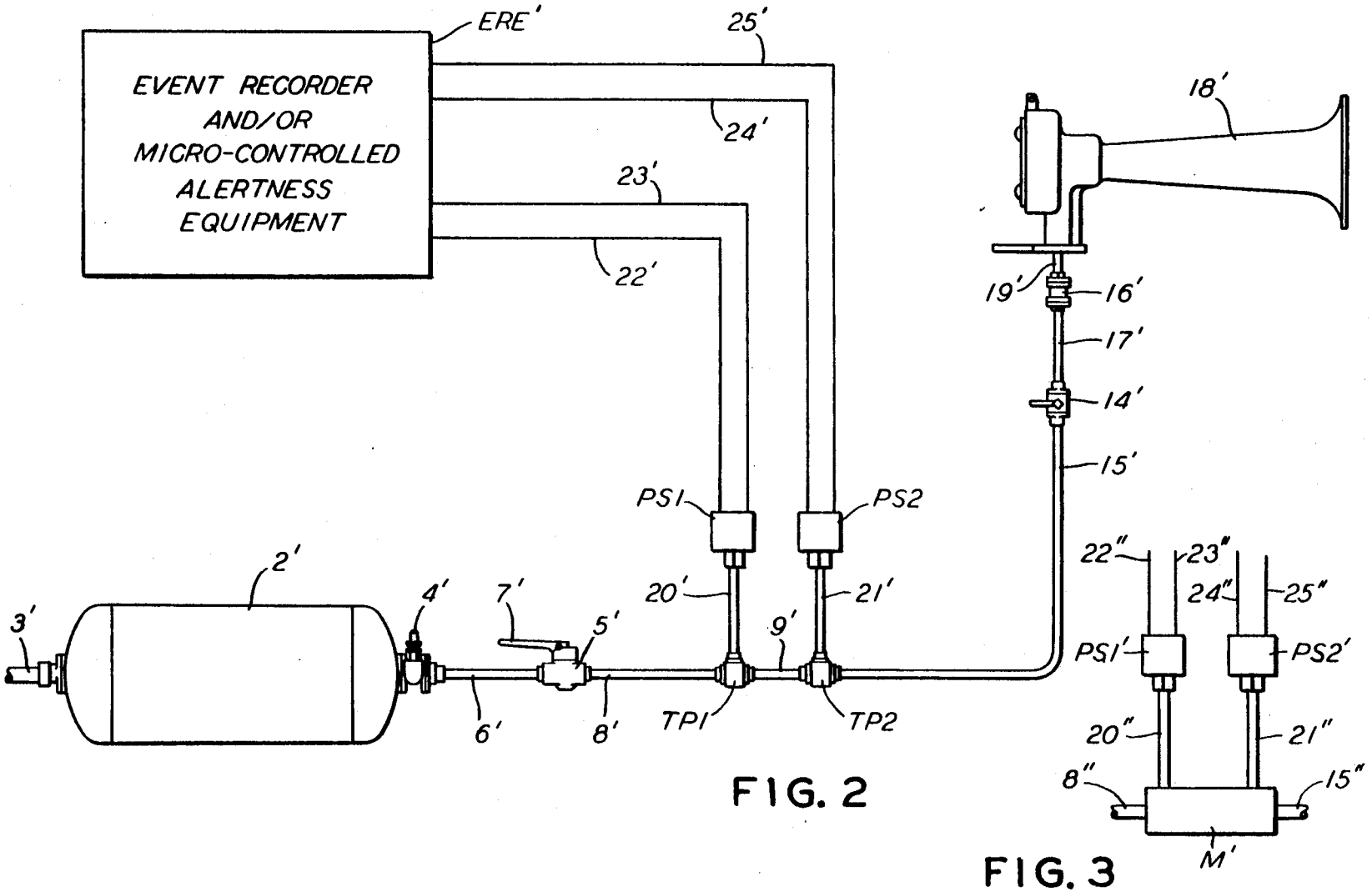
FIG. 2 is a schematic diagram of a modified form of a recording and monitoring system of determining the sounding of an air horn on a railway vehicle in accordance with the present invention.
FIG. 3 is a partial schematic diagram of a manifold and a pair of pressure transducers which may be used in the system of FIG. 2.

With reference now to FIG. 2, there is shown a modified embodiment of a monitoring and recording system for ascertaining the actual sounding of the warning horn 18' by the actuation of the whistle valve 5' by the operator of a railway vehicle as the train approaches a potentially dangerous area. It will be seen that the components or elements of FIG. 2, which are the same as those in FIG. 1, are characterized by the same reference numbers and letters which are primed. As shown, the system, generally characterized by number 1', includes a suitable source of air pressure, such as main reservoir 2' which is connected by pipe or conduit 3' to a suitable air compressor (not shown). The outlet pressure of the main reservoir 2' is controlled by a safety valve or regulator 4' which is adjusted to between 125–145 psi. It will be seen that the outlet of the pressure regulating device 4' is connected to a manually operated whistle valve 5' via pipe or conduit 6'. As previously mentioned, the whistle valve 5' may be a standard A-2 flow control device. The manual valve device 5' includes a pull handle 7' which is operated by the trainman to initiate the operation of a pneuphonic horn 18'.

It will be noted that the outlet of the whistle horn 5' connected by pipe or conduit 8' to the inlet of a first tee-pipe fitting TP1 which has its outlet connected to the inlet of a second tee-pipe fitting TP2 by a pipe or conduit 9'. As shown, the outlet of the second tee-pipe fitting TP2 is connected to the inlet of a normally opened cutout cock 14' via pipe or conduit 15'. The outlet of the cutout cock 14' is connected by pipe or conduit 17' to inlet of an air strainer 16' which removes dirt and other foreign matter. The outlet of strainer 16' is connected to the pneuphonic horn 18 via pipe or conduit 19'. As previously mentioned, on most railroads, it is generally an accepted practice for the locomotive engineer to sound the warning horn as the train approaches a highway common grade crossing or a track work area. As shown, a pressure pipe or conduit 20' is connected from an outlet of the first tee-pipe fitting TP1 to the inlet of a first pressure switch PS1. In the present instance, let us assume that the warning device 18' is a type E-2-B pneuphonic horn which has a threshold pressure level in the order of 40 psi at the whistle valve discharge line 8'. The loud sound emitted by the pneumatic or pneuphonic horn 5' may be heard as far as three (3) miles away and farther. The high pressure sensing switch PS1 is set to close a pair of electrical contacts at the 40 psi threshold level to signal the event recorder equipment ERE' via leads 22' and 23' that sufficient air pressure has been delivered to sound the pneuphonic horn 18' and to provide an adequate audible warning. The lack of a signal may be interpreted that either the engineer did not actuate the horn valve 5' or the pressure of the main reservoir 2' is below the threshold setting of the pressure sensing switch PS1. It will be appreciated that, during a low pressure condition, the operator could be accused of not blowing the horn because no such event was recorded In order to alleviate any doubt during a low main reservoir pressure, the second pressure switch PS2 provides a signal on leads 24' and 25' to positively indicate that the engineman did indeed operate whistle valve 5' to blow the air horn 18'. In practice, the pressure switch PS2 is set to close a pair of electrical contacts at a relatively low pressure level such as 5 to 10 psi. Thus, a signal on leads 24' and 25' would provide a practical indication of all horn valve operations which could be used for determining the alertness of the engineman, as well as for recording the positive action of the engineman. Thus, not only the operator's action in actuating the whistle horn 5' for initiating the blowing of the pneumatic horn, but also the resultant development of sufficient pressure to sound the horn 5' is monitored and/or recorded.

Referring now to FIG. 3, there is shown a partial slightly modified version of the system of FIG. 2 in which the same components are double primed. As shown, the feed pipe or supply conduit 8" is connected to the inlet of a multi-outlet manifold M which has one outlet connected to delivery pipe or conduit 15". As shown, another outlet of the manifold M is connected to pipe or conduit 20" while the third outlet of manifold M is connected to pipe or conduit 21". It will be seen that the pipe 20" is connected to the high level pressure responsive switch PS1' while the pipe 21" is connected to the low level pressure responsive switch PS2'. It will be appreciated that the pressure switch PS1' closes an electrical circuit for developing a signal on leads 82" and 23" when the pressure level reaches approximately 40 psi, while the pressure switch PS2" closes an electrical circuit for developing a signal on leads 24" and 25" when the pressure level only reaches approximately 5 to 10 psi. As previously mentioned, the closure of the low pressure switch PS2' signifies that the operator has actually initiated an effort to sound the warning horn while the closure of the high pressure switch PS1 ' signifies that sufficient pressure has been delivered to the pneuphonic horn 18' for sounding the audible warning signal. As noted above, the sounding of the warning is recorded and is correlated with the time, date and location by the event recorder for review and examination at a later time.

Thus, the present invention has been described in such full, clear, concise and exact terms as to enable any person skilled in the art to which it pertains to make and use the same, and having set forth the best mode contemplated of carrying out this invention. I state that the subject matter, which I regard as being my invention, is particularly pointed out and distinctly asserted in what is claimed. It will be understood that variations, modifications, equivalents and substitutions for components of the above specifically-described embodiment of the invention may be made by those skilled in the art without departing from the spirit and scope of the invention as set forth in the appended claims. For example, the warning horns may be replaced by air-operated bell devices on locomotives and other changes, such as, other sensing switches having different threshold levels, may be used in other installations and applications.

I claim:

1. A system for determining the operation of a pressure operated audible warning device of a railway vehicle comprising, a source of air pressure, an actuating valve for directing the flow of air under pressure to sound said warning device, means for sensing the flow of air under pressure, said sensing means includes an air flow adapter which is connected between said actuating valve and said warning device, and means for recording the operation of said actuating valve and the sounding of said warning device.

2. The system as defined in claim 1, wherein said air flow adapter is connected to an air flow indicator which senses the flow rate of the air pressure flowing to said warning device.

3. The system as defined in claim 1, wherein said recording means is an event recorder which records the time, date, and location of the operation of said actuating valve and the sounding of said warning device.

4. The system as defined in claim 1, wherein said warning device is an air horn of a railway vehicle.

5. The system as defined in claim 1, wherein said source of air pressure is a reservoir.

6. A system for determining the operation of a pressure operated audible warning device of a railway vehicle comprising, a source of air pressure, an actuating valve for directing the flow of air under pressure to sound said warning device, means for sensing the flow of air under pressure, said sensing means includes a pair of tee members connected between said actuating valve and said warning device, and means for recording the operation of said actuating valve and the sounding of said warning device.

7. The system as defined in claim 6, wherein one of said pair of tee members is connected to a first pressure sensitive switch which is responsive to a high pressure level.

8. The system as defined in claim 7, wherein the other of said pair of tee members is connected to a second pressure sensitive switch which is responsive to a low pressure level.

9. The system as defined in claim 8, wherein said first and second pressure sensitive switches are connected to said recording means.

10. A system for determining the operation of a pressure operated audible warning device of a railway vehicle comprising, a source of air pressure, an actuating valve for directing the flow of air under pressure to sound said warning device, means for sensing the flow of air under pressure, said sensing means includes a manifold connected between said actuating valve and said warning device, and means for recording the operation of said actuating valve and the sounding of said warning device.

11. The system as defined in claim 10, wherein said manifold is connected to a high pressure switch and to a low pressure switch.

12. The system as defined in claim 11, wherein said high pressure switch and said low pressure switch are connected to said recording means.

13. A warning alarm arrangement for ascertaining that an operator of railway locomotive has taken positive action to sound an air horn, comprising, a compressed air supply, a manual operating valve pneumatically connected to said compressed air supply, an air flow adapter pneumatically connected to said manual operating valve, said air horn pneumatically connected to said air flow adapter, an air flow indicator pneumatically connected to said air flow adapter, and an event recorder electrically connected to said air flow indicator for recording the actuation of said manual operating valve and the sounding of said air horn.

14. A warning alarm arrangement for determining that an operator of a railway vehicle has taken action to sound an air horn comprising, a compressed air supply, a manual operating valve pneumatically connected to said compressed air supply, a pair of tee members pneumatically connected to said manual operating valve, said air horn is pneumatically connected to said pair of tee members, a pair of pressure switches pneumatically connected to said pair of tee members, and an event recorder electrically connected to said pair of pressure switches for recording the actuation of said manual operating valve and the sounding of said air horn.

15. A warning alarm arrangement for ascertaining that an operator of a railway vehicle has taken action to sound an air horn comprising, a compressed air supply, a manual operating valve pneumatically connected to said compressed air supply, a manifold pneumatically connected to said manual operating valve, said air horn pneumatically connected to said manifold, a pair of pressure switches pneumatically connected to said manifold, and an event recorder electrically connected to said pair of pressure switches for recording the actuation of said manual operating switch and the sounding of said air horn.

* * * * *